US009282831B2

(12) United States Patent
Scibetta et al.

(10) Patent No.: US 9,282,831 B2
(45) Date of Patent: Mar. 15, 2016

(54) FOOD DISPLAY COUNTER

(71) Applicant: CIERREESSE S.r.l., Cabiate (IT)

(72) Inventors: Santo Scibetta, Barzago (IT); Ettore Racchelli, Verbania (IT)

(73) Assignee: CIERREESSE S.r.l., Cabiate (CO) (IT)

( * ) Notice: Subject to any disclaimer, the term of this patent is extended or adjusted under 35 U.S.C. 154(b) by 0 days.

(21) Appl. No.: 14/279,560

(22) Filed: May 16, 2014

(65) Prior Publication Data

US 2015/0327692 A1 Nov. 19, 2015

(51) Int. Cl.

| | |
|---|---|
| ***A47F 3/04*** | (2006.01) |
| ***F25D 11/00*** | (2006.01) |
| ***A47F 3/06*** | (2006.01) |

(52) U.S. Cl.

CPC ..... *A47F 3/063* (2013.01); *A47F 3/0408* (2013.01); *A47F 3/0426* (2013.01); *A47F 3/0486* (2013.01); *A47F 2003/066* (2013.01)

(58) Field of Classification Search

CPC ... E05Y 2900/20; A47F 3/043; A47F 3/0434; E05D 15/10

USPC ..... 312/116

See application file for complete search history.

(56) References Cited

U.S. PATENT DOCUMENTS

| | | | | |
|---|---|---|---|---|
| 2,994,572 | A * | 8/1961 | Morrison | 312/116 |
| 3,508,361 | A * | 4/1970 | Ryder | 49/70 |
| 4,644,690 | A * | 2/1987 | Caimi | 49/130 |
| 4,669,219 | A * | 6/1987 | Tomida | 49/130 |
| 4,753,084 | A * | 6/1988 | Aoki | 62/246 |
| 5,726,868 | A * | 3/1998 | Koyama et al. | 361/832 |
| 5,996,282 | A * | 12/1999 | Giovannetti | 49/130 |
| 7,254,918 | B2 * | 8/2007 | Fronz et al. | 49/122 |
| 8,308,249 | B2 * | 11/2012 | Matus, Jr. | 312/140.4 |
| 8,375,646 | B2 * | 2/2013 | Newkirk et al. | 52/29 |
| 8,438,783 | B2 * | 5/2013 | Giovannetti | 49/130 |
| 8,763,205 | B2 * | 7/2014 | Schmidhauser et al. | 16/92 |
| 2006/0101718 | A1 * | 5/2006 | Fronz et al. | 49/141 |
| 2008/0078199 | A1 * | 4/2008 | Atas et al. | 62/382 |
| 2011/0080075 | A1 * | 4/2011 | Matus, Jr. | 312/140.4 |

(Continued)

FOREIGN PATENT DOCUMENTS

| | | |
|---|---|---|
| DE | 295 17 371 | 12/1995 |
| EP | 2 332 447 | 6/2011 |
| FR | 1 392 334 | 3/1965 |

OTHER PUBLICATIONS

Italian Search Report dated Jul. 10, 2013, corresponding to Italian Application No. MI20121948.

*Primary Examiner* — Daniel J Troy
*Assistant Examiner* — Kimberly S Wright
(74) *Attorney, Agent, or Firm* — Young & Thompson

(57) ABSTRACT

A food display counter (10) in which the chamber (14) for housing food products is closed at the upper part by a fixed longitudinal panel (22) and by a mobile longitudinal panel (24) which are arranged coplanar in a horizontal plane and the mobile panel in its open position is in a horizontal plane superimposed with respect to the fixed panel. The mobile panel is fixed at its ends respectively to a control device (27) which includes an electrical actuator (30) actuating to and fro a slider (36) with vertical guides (46), a horizontal guide (34) fixed to a sheet (28) supporting the actuator (30), same case applying to a plate (50) which supports the mobile panel and it also has a bearing (58) cooperating with an oblique cam (60) which is fixed to the sheet and determines the execution of the opening and closing movement of the mobile panel.

14 Claims, 6 Drawing Sheets

(56) References Cited

U.S. PATENT DOCUMENTS

2011/0138833 A1 6/2011 De Blasi
2011/0185638 A1* 8/2011 Giovannetti ..... 49/414
2012/0043865 A1* 2/2012 Newkirk et al. ..... 312/209
2012/0062080 A1* 3/2012 Maslen ..... 312/116
2012/0260460 A1* 10/2012 Schmidhauser et al. ..... 16/92
2013/0008090 A1* 1/2013 Lanzl et al. ..... 49/413
2013/0020918 A1* 1/2013 Mascheroni ..... 312/319.1
2014/0082886 A1* 3/2014 Bortoluzzi et al. ..... 16/97

* cited by examiner

FOOD DISPLAY COUNTER

TECHNICAL FIELD

The present invention refers to a food display counter according to the preamble of claim 1.

Technological Background and State of the Art

As known, in shops, supermarkets, pastry shops, ice cream shops, chocolate shops, food shops, restaurants and the like, there are usually installed small counters or glasses with a chamber for housing/displaying food products which is at times refrigerated, in particular for pastry shop, ice cream shop, frozen food products and the like.

Some of these counters or displays are provided with transparent walls made of glass or synthetic material and a support plane on which there are displayed the products offered for sale. At times, the rear wall of the counter is open so that the seller may have free access to the chamber containing the products and directly picking the product selected by the purchaser, wherein in these counters it is required to cover and protect the displayed products so as to prevent the pollution thereof due to insects, dust and the like.

Likewise, in restaurants there are known counters or displays mobile on wheels, or trolleys, containing foods of various types and delicacies. These trolleys typically comprise a transparent cover made of synthetic material, hinged at the ends thereof to the structure of the trolley, hence, the compartment containing the products is more protected and the cover is opened and closed manually only when picking the food product and closed immediately thereafter. However, such construction is not ideal for shop counters extended length-wise, like it is at times required for pastry shops and ice cream shops, which should have panels that can be opened, respectively larger and heavier, hence not removable manually.

In addition, there are food trolleys for restaurants in which a dome-shaped cover opens and closes in a hinge-like manner through an electrical motor. Document US 2011/0080075 A1 discloses a small transformable food display device having two lateral tubular support structures, the display device being moveable manually from any resting surface or support table to the other. The display device has adjustable panels and it can be used both in case of a restaurant, i.e. with cafeteria mode-attendant service, same case applying for example to a bar or self-service, i.e. buffet mode, hence said transformable food display device may be used at will both in restaurants as well as bars, cafés, cafeterias and the like.

The proposed transformable and manually moveable display device has a plurality of transparent panels associated to two lateral tubular support structures 420 (FIGS. 4A, 4B), two lateral hinge-like mechanisms 425, as well as fixed lateral panel 410 and a slidable lateral panel 435.

Carefully reading this document reveals that the lateral components 325 (FIG. 3B) and 425 (FIG. 4A, 4B), having a substantially L-shaped configuration, do not have guides with trolleys orthogonal to each other but they are simple hinge mechanisms adapted to determine a movement or rotation of an associated mobile panel from a horizontal position to a vertical position and vice versa.

Hinge mechanisms 425 of the indicated type are provided in various illustrated embodiments, such as for example indicated with the reference number 525 in FIG. 5A.

In the various embodiments of transformable and manually moveable display devices disclosed by documents US 2011/0080075 A1 there are no independent guides orthogonal to each other.

Document FR1392334A illustrates a refrigerator showcase open from above with removable cover. The refrigerator showcase has a cover formed by a fixed upper wall, limited by the rear wall, it extends over the entire width of the cabinet and stops at about half the upper opening, as well as a mobile cover plate, wherein the upper edges of the lateral walls have tracks on which the mobile cover plate can be moved from a rear position, freeing the opening of the cabinet, to a front position which closes the opening.

Document EP 2332447 A1 discloses a refrigerator showcase for ice creams with low energy consumption and with an improved protection of the products contained therein. It is provided with two thermal-insulating transparent panels arranged over basins 4 and 5, on which they can be extended to cover the entire refrigerating space, or superimposed towards the external edge to free the internal row of basins and, in this position, if required, they can be raised by rotation, to allow access to all basins. The movements may be carried out manually or through driving means.

Document 29517371 U1 discloses a fridge for displaying and/or selling ice creams, frozen products or the like, in which to the upper opening there is associated a substantially plate-like cover element moveable between a closing position and an opening position, with associated restoration means adapted to automatically lead the cover element to the closing position, wherein to the cover element there are associated delay means capable of braking the closing movement in the final step thereof.

DESCRIPTION OF THE INVENTION

This invention aims at providing a food display counter capable of overcoming the drawbacks or limits of the prior art and meeting the requirements regarding display counters of large dimensions.

The counter according to the invention may have a refrigerated or non-refrigerated chamber for accommodating food products and it shall also allow solutions particularly extended length-wise still providing a reliable, smooth and continuous opening/closing movement, requiring little space, which can be executed automatically and allowing maximum ease of access to the displayed products with the maximum safety with respect to the seller and clients.

The aforementioned task is solved, according to the invention, through a food display counter having the characteristics of claim 1.

Further advantageous embodiments of the proposed counter can be observed from the dependent claims.

Various advantages are obtained through the display counter according to the invention.

Firstly, the cover of the counter, made of transparent material like glass or crystal, is provided horizontal on the upper part of the counter and formed by two adjacent and coplanar panels in the closed position, one of whose panels is fixed and the other is mobile and moveable while opening partly above the fixed panel in horizontal position, thus on the mobile panel in opening position it is possible to temporarily place the purchased products awaiting the weighing and packaging thereof.

Regarding thus, a further advantage lies in the fact that the display counter is directly associated on one side to a cabinet for housing a weighing device, for example of the type with slidable support surface substantially flush-mounted, with associated a cash register device, for example of the integrated electronic type, and a packaging area, this also allowing rationalising the sales process, requiring less installation surface with respect to the separate weighing points, cash register and packaging as well as requiring less personnel.

The opening of the counter occurs like a longitudinal slot over the entire length of the counter and it can be obtained, as the closure, electrically through a button control that is easily and quickly accessible to the seller at only one or both ends of the counter, hence the opening/closing times are established by the seller alone and only for the period of time strictly required to pick the products, wherein the time for moving the mobile panel is relatively short hence also obtaining a considerable saving of energy as regards the refrigerated counters.

The devices for moving the mobile panel are housed inside the counter as a blind integral part thereof without jeopardising the aesthetic aspect of the counter and limiting the volume of the chamber for displaying the products in a substantially marginal manner due to their limited thickness.

The conformation of the counters according to the invention with the new disclosing position with coplanar horizontal panels is obtained parallelepiped-shaped, thus facilitating a quick and complete view of the displayed products just like the quick cleaning of the counter.

The functional interposition, according to the invention, of an oblique rectilinear cam between two guide arrangements orthogonal to each other allows obtaining a smooth and continuous translation movement of the mobile panel in a horizontal position along an oblique raising/lowering path with a compact construction of the lateral actuation or control devices for controlling the opening/closing, hence the fixing of these control devices on the sideboards of the counter reduces—only in a substantially marginal manner—the volume of the chamber for containing the products, and this also in case of counters with length, for example, 2.160 m and with a width of about 1 m, in which the weight of the mobile crystal panel is of about 30 kg and the weight of said lateral devices for controlling the opening/closing is of about 25 kg.

BRIEF DESCRIPTION OF THE FIGURES

Further characteristics, advantages and details of the food display counter of the present invention shall be more apparent from the following description of a preferred embodiment, illustrated by way of example in the attached drawings, which are schematically shown, in different scales for better clarity of illustration.

PREFERRED EMBODIMENT

Figure 1:
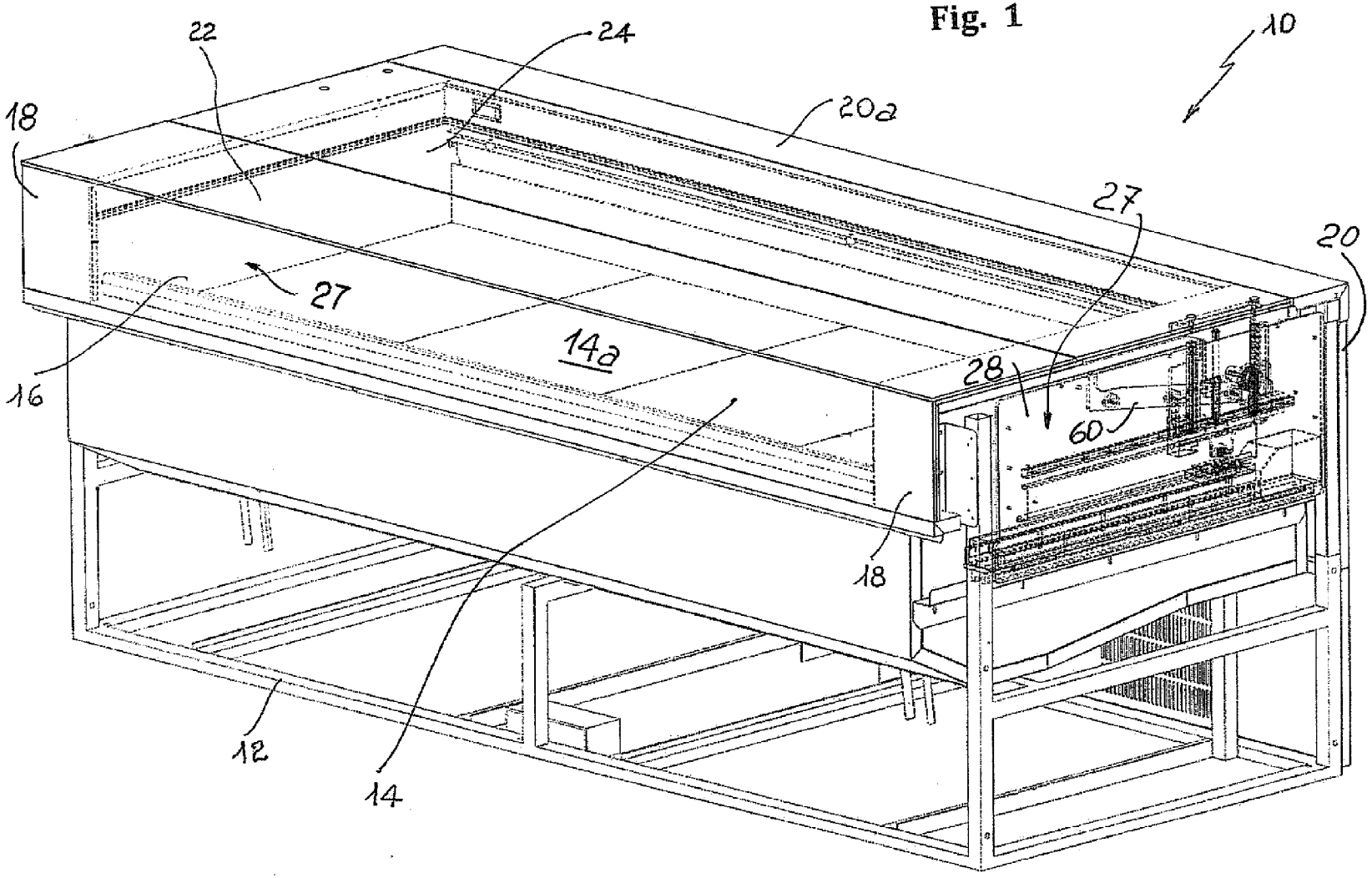
FIG. 1 shows a front perspective view, i.e. on the client's side, of the display counter with the mobile panel in the closing position.
Figure 2:
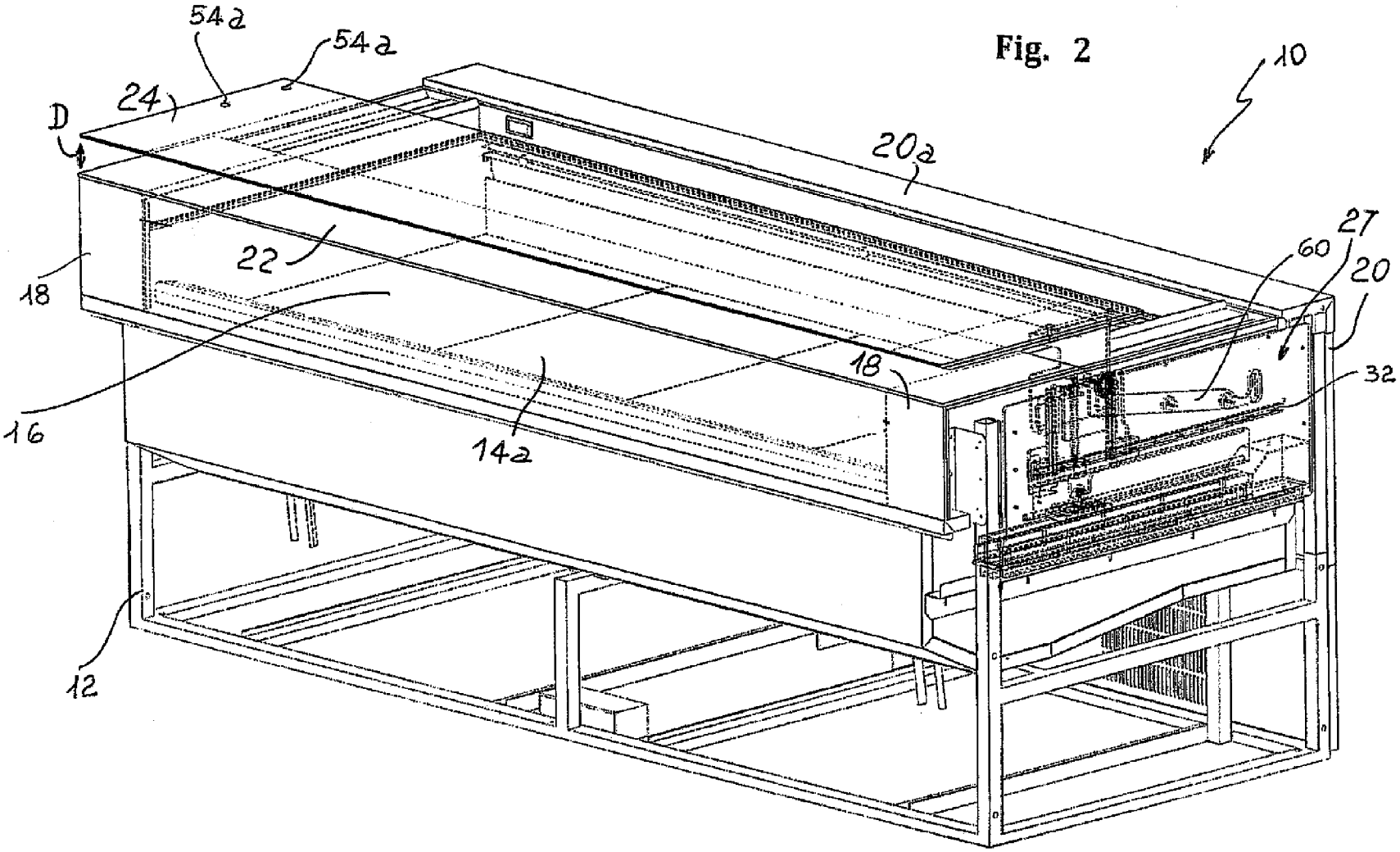
FIG. 2 shows a perspective view of the display counter analogous to that of FIG. 1, with the mobile panel in the opening position.
Figure 3:
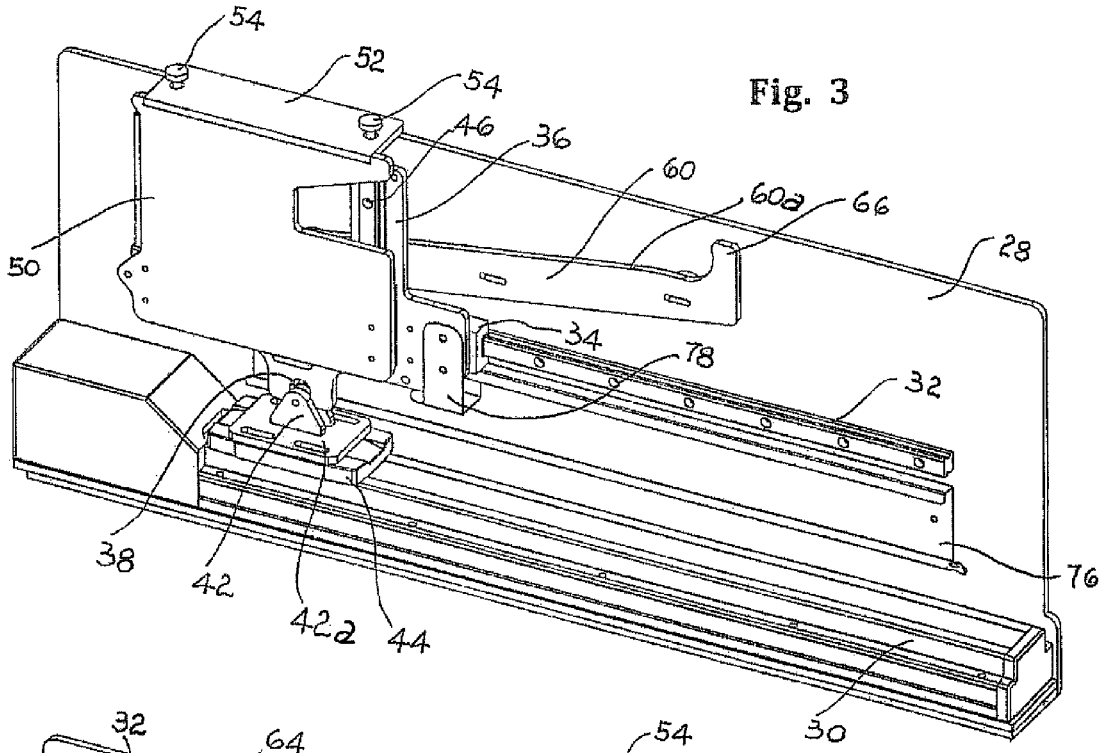
FIG. 3 shows a perspective view of one of the two lateral actuation or control devices of the display counter in the closing condition of the mobile panel (not illustrated)
Figure 4:
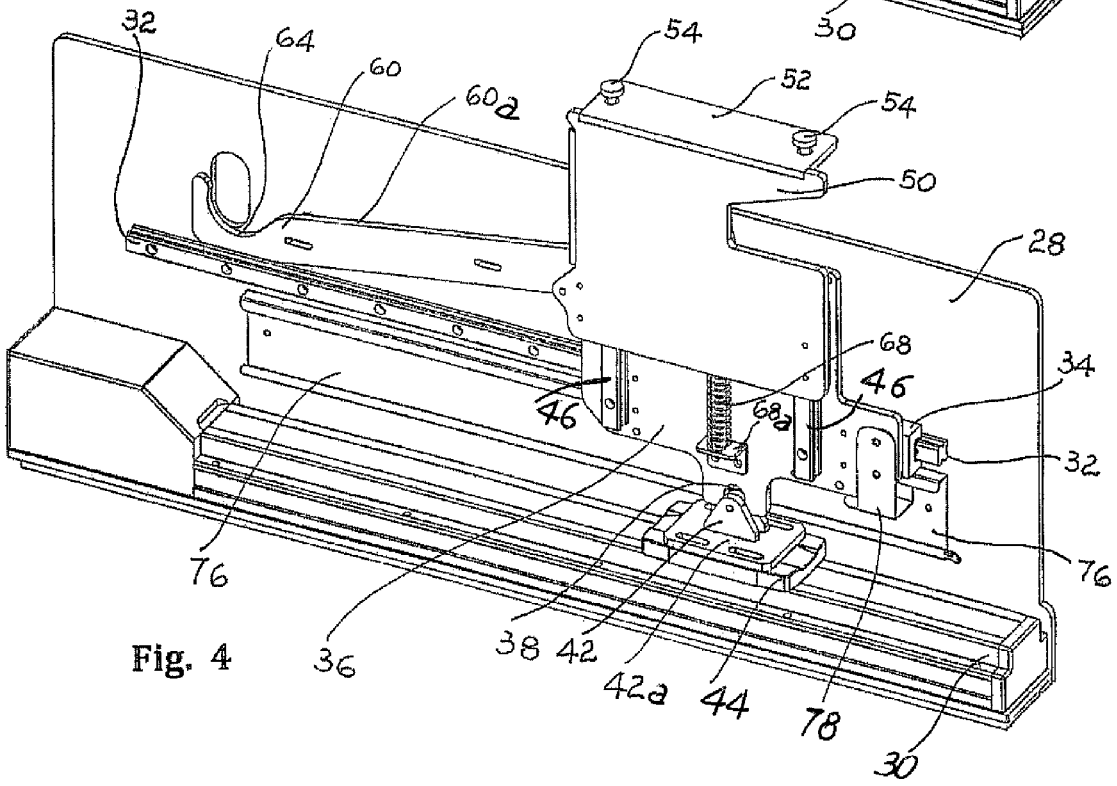
FIG. 4 shows a perspective view analogous to that of FIG. 3, but with the actuation device of FIG. 3 in its position for opening the mobile panel (not illustrated)

First, with reference to FIGS. 1 and 2 the display counter according to the invention is indicated in its entirety with 10 and it substantially comprises a support framework 12 and a containment vat 14, refrigerated in the example, which is delimited by a front vertical sheet 16, i.e. the client side, for example made of glass or crystal, which extends over the entire length of the counter 10 and is connected at its ends to the heads or sideboards 18 of the counter, which extend over the entire width of the counter 10. The rear side 20 of the counter, i.e. the seller side, for example made of steel, has—at the upper part—a folded end 20*a* extending horizontally and coplanar with the upper sides of the sideboards 18 also made of steel. The counter 10 has—at the upper part—a transparent horizontal cover, for example made of glass or crystal, formed by a fixed longitudinal panel 22 and a mobile longitudinal panel 24, coplanar to each other, wherein the fixed panel is fixed at its ends to the sides 18, while the mobile panel 24 is supported, in the illustrated example, at its ends respectively by a plate 50, FIGS. 3 and 4, for supporting the mobile panel 24, wherein in the closing position of the counter said mobile panel 24 is coplanar in the horizontal surface of said fixed panel 22 and the upper horizontal folding 20*a* of the rear side 20 of the counter 10. The movement of the mobile panel 24 to its opening position, i.e. towards the client side FIG. 2, obviously allows the seller complete access into the vat 14, which receives—on the bottom 14*a* thereof—the food products to be sold (not illustrated), while beneath said bottom 14*a* there is housed the counter refrigeration system (not illustrated) if provided for.

Furthermore, FIG. 2 shows that in the position of opening the mobile panel 24 the latter is arranged parallel above the fixed panel 22 with a small distance D of, for example, 8-10 cm.

Figure 5:
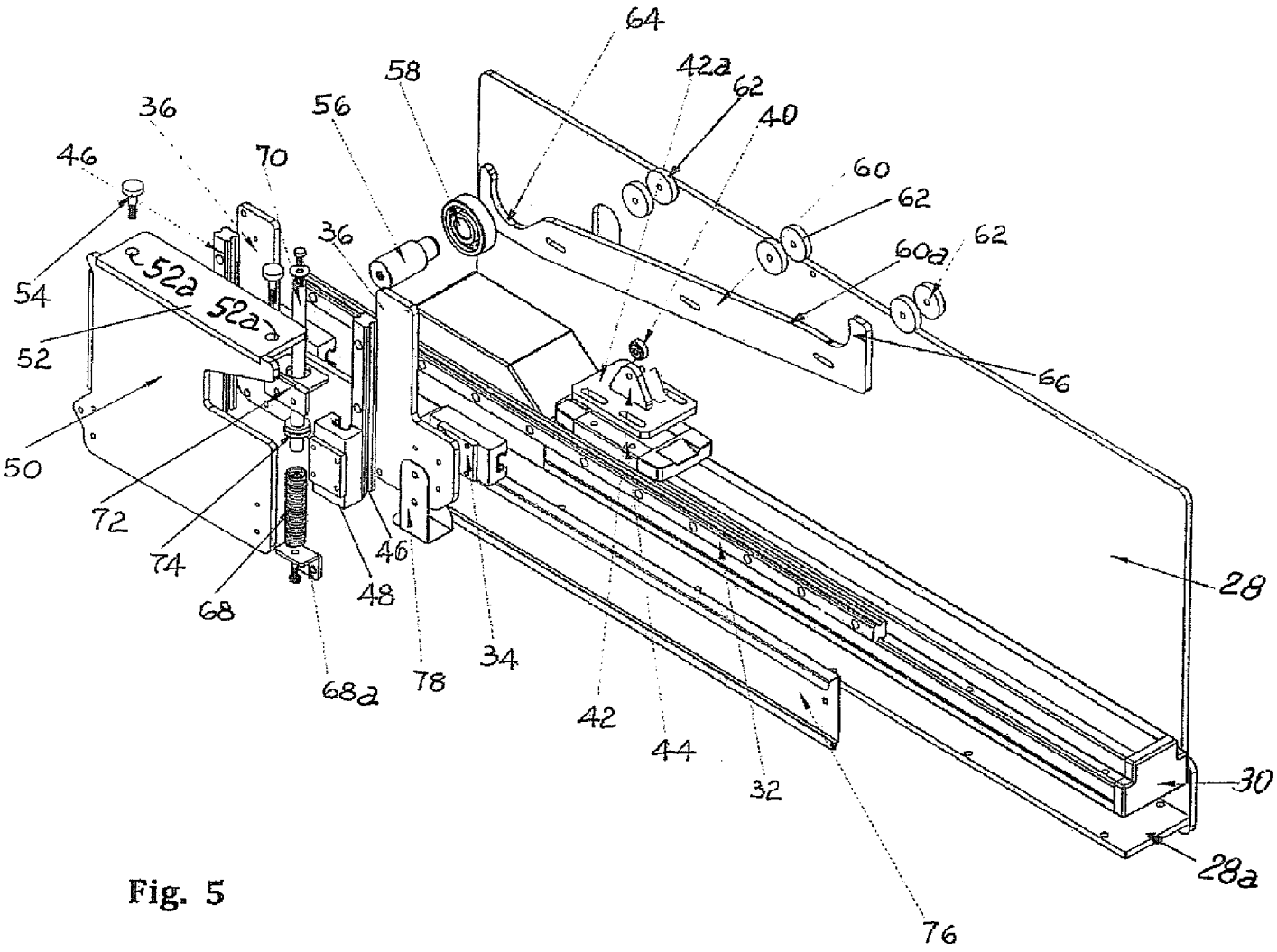
FIG. 5 shows an exploded view of the actuation device as illustrated in FIG. 3 for a clearer illustration of the various components of the actuation device.
Figure 6:
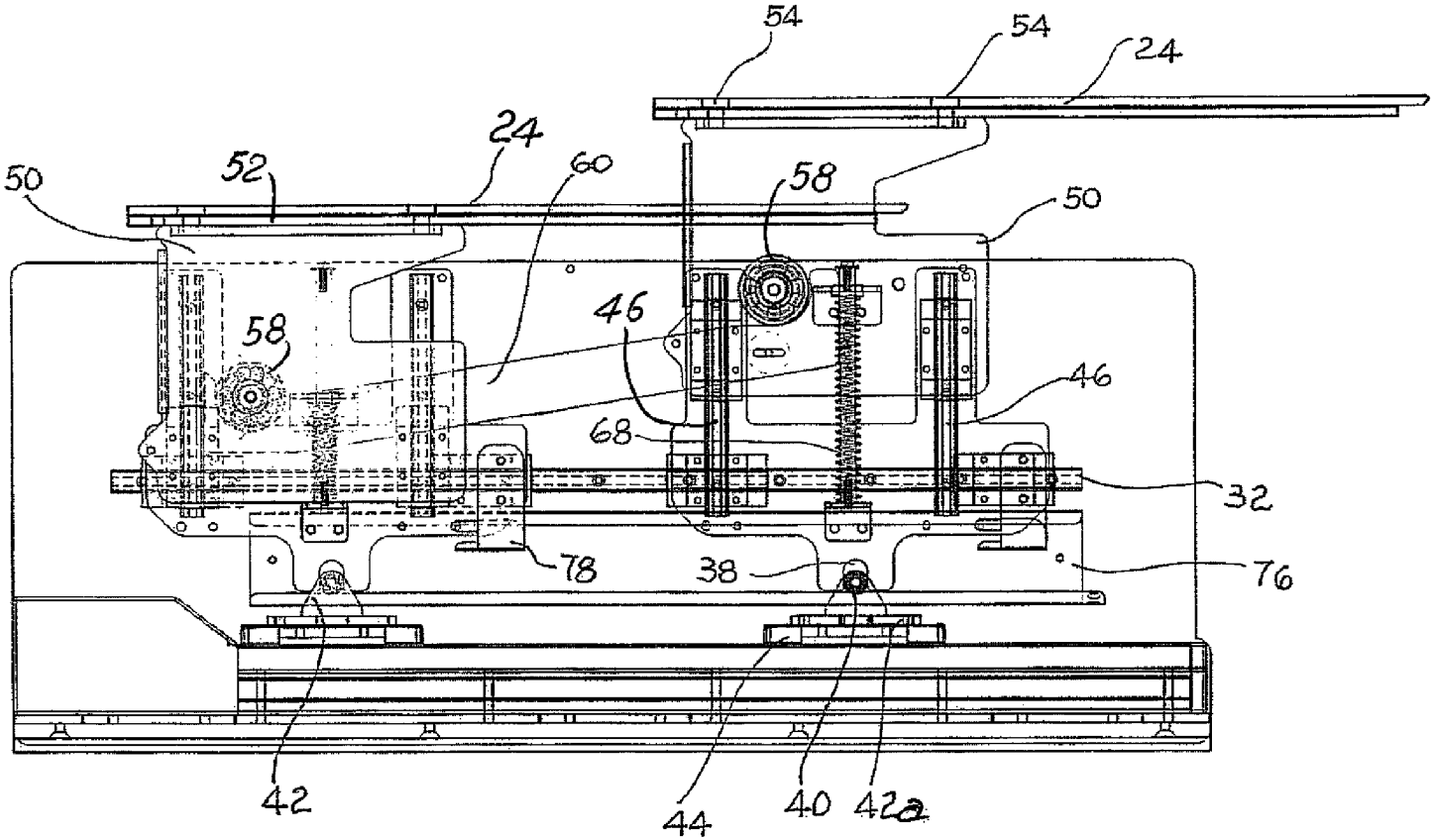
FIG. 6 shows a front view on the actuation device in FIG. 3 with its main components, with the mobile panel in the closing position, on the left, and opening position, on the right.

According to the invention, each of the two provided lateral actuation devices 27, for opening/closing the mobile panel 24, is housed on a support sheet 28, which is fixed internally respectively to a sideboard 18 of the counter 10, and it separately comprises:

- an electrical actuator 30 fixed to the orthogonal base 28*a* of the support panel 28, the actuator 30 extending along said support panel 28 and having a slide 44 supporting—at the upper part—a driving roller 40, FIG. 5, through a support 42 with a plate 42*a*,
- a horizontal guide 32 fixed to the support sheet 28 and extending along the same above said electrical actuator 30,
- at least one trolley 34 slidable on said horizontal guide 32 and fixed to a plate-like slider 36, the slider having—at the lower part—a seat 38 for housing said driving roller 40 and being longitudinally translatable parallel to said support sheet 28,
- two vertical guides 46 extending—spaced from each other and fixed on said slider 36—on the side opposite to that supporting the at least one trolley 34 slidable on the horizontal guide 32,
- at least one trolley 48 slidable on each vertical guide 46 and fixed to a support plate 50 parallel with respect to said slider 36 and supporting the mobile panel 24, wherein on the side facing towards said slider 36 the plate 50 has a pin 56 which supports a bearing 58 adapted to roll, during the opening and closing movement of the mobile panel 24, on the profiled edge of an oblique linear cam 60 fixed to the sheet 28 and adapted to determine an oblique raising movement of said plate 50 for supporting the mobile panel 24 from a lower or closing position of said mobile panel 24 with translation of the slide of the actuator 30 in a longitudinal direction, or a lowering oblique movement of said support plate 50 from an upper or opening position to the lower or closing position, with translation of the slide 44 of the actuator 30 in the other direction of movement.

The two actuators 30 are referred to by the LEFS 32B-500-R36P1 serial numbers and they are manufactured by the Italian company SMCI.

The two actuators 30 are connected synchronised and the movements of the slide 44 occur, for example, by actuating the switches 18A and 18B provided for, for example either on one sideboard 18 or, in case of long counters measuring, for example, 2 or more meters, on both sideboards 18, so as to allow easy access by the seller on one or the other end of the counter.

In practice said cam 60 is fixed to the support sheet 28 in a known manner by interposing spacers 62, to allow the free rolling of the bearing 58 on the thickness of the oblique side 60*a* of the cam 60. The latter has—at one end a housing cavity 64, in which there is arranged the bearing 58 in abutment with the mobile panel 24 in closing position. On the other end, the cam 60 has a projection 66 forming an element for stopping the translation movement of the bearing 58.

In order to initially facilitate the lifting movement for the exit of the bearing 58 from its hollow seat 64, according to the invention there is advantageously provided a support and elastic thrust device, formed by a helical spring 68 operating in expansion and fitted on a vertical stem 70. This stem 70 is vertically guided along a bushing 74, traverses an L-shaped support 72, fixed to the side of the slider 36 facing towards the plate 50 for supporting the mobile panel 24, wherein said helical spring 68 is supported—at the lower part—on an abutment support 68*a* also fixed to the slider 36, as observable from FIGS. 4 and 5.

In addition, FIGS. 3-6 show that below the linear guide 32 to the sheet 28 there is fixed an open C-shaped channel 76, which serves for housing power supply cables of the associated electrical actuator 30, wherein to said channel 76 there is for example associated a shaped support plate 78, which is fixed to the support sheet 28 and allows an anchorage of the sheath of said cables.

In the illustrated example the fixing of the end of the mobile panel 24 to the respective support plate 50 occurs through two screws 54 which traverse two holes 54*a* in the mobile panel 24 (FIG. 2) and they are screwed in threaded holes 52*a* (FIG. 5) provided for in a plate 52 fixed—at the upper part—to the support plate 50 or formed by a folding of the latter.

Regarding the two lateral control devices 27 there should be observed the mutually parallel positioning between the support sheet 28 with the oblique rectilinear cam 60, the plate-like slider 36 and the plate 50 supporting the mobile panel 24, whose positioning allows a particularly narrow and compact embodiment of said lateral control devices 27.

Figure 7:
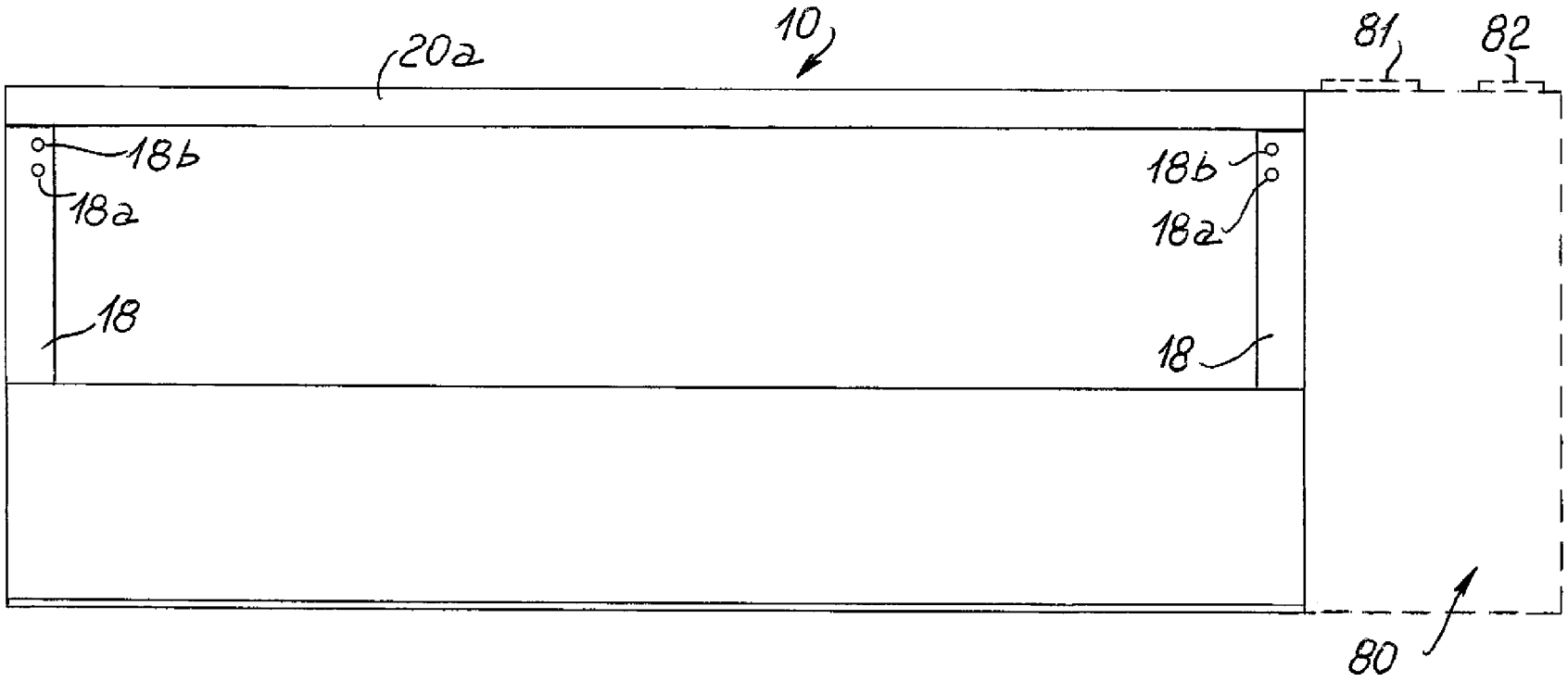
FIG. 7 shows a rear view, i.e. on the seller's side, of the counter according to the invention.

In addition, FIG. 7 shows that on the sideboards 18 there are provided two switches 18*a* for controlling the actuators 30 for opening/closing the mobile panel 24, wherein in case of shorter counters it will be sufficient to provide only one switch 18*a* for an easy control of the mobile panel by the seller. Two safety switches for the instantaneous stopping of the actuators 30 are indicated with 18*b*.

Lastly a cabinet 80 is indicated in FIG. 7 with dashed line for housing a device 81 for weighing the purchased products and a cash register device 82, wherein adjacent and between said devices 81 and 82 there is provided a free surface for packaging the purchased products.

Operation

The opening and closing operation of the counter according to the invention can now be easily observed from the description and the drawings.

Starting from the closing position of the mobile panel 24 of the counter 10 observable from FIG. 1, the opening of said mobile panel 24 is activated by the seller by pressing a switch 18*a* for the electrical supply of the two actuators 30.

For the sake of simplicity, hereinafter there is described the movement of only one of the two lateral control devices 27, whose movements shall occur synchronised.

By supplying the actuator 30 its slide 44 shall start a longitudinal travel, during which through the driving roller 40 the plate-like slider 36 shall similarly perform a longitudinal translation parallel to the support sheet 28 by sliding along the horizontal guide 32 of its trolley 34.

During this translation, there shall also occur a rolling of the bearing 58 on the oblique portion 60*a* of the cam 60, with the ensuing progressive lifting of the support plate 50 in the vertical direction according to an inclined trajectory following the sliding of the trolleys 48 along the respective vertical guides 46, wherein the initial rolling movement of the bearing 58 outside its rounded seat 64 shall be advantageously facilitated by the action of the spring 68 which, initially entirely compressed, expands progressively. Following the connection of the slider 36 with the horizontal guide 32 through the trolley 34, and the connection of the vertical guides 46 of the slider 36 with the plate 50 through the trolleys 48, as well as the connection of the roller bearing 58 with the plate 50 through the pin 56, wherein the longitudinal movement of the slide 44 leads to a progressing lifting of the mobile panel 24 and the movement thereof towards the client's side, i.e. advancement with respect to the underlying fixed panel 22 which shall be practically surmounted by the mobile panel 24 in its final opening position, FIG. 2, for a limited distance D measuring, for example, 8-10 cm. The sequence of the movements of the various components during the opening step described further above shall occur in an inverted manner for the lowering or closing movement of the mobile panel 24.

In the case of the variant of the counter according to FIG. 7, after purchasing the product selected by the client said product is arranged, for example by the seller himself/herself, on the adjacent weighing device 81 and the electronic cash register device 82 shall issue the relative sales receipt.

From the structural and functional description outlined further above it can be observed that the food display counter according to the present invention allows efficiently solving the previously described task and as well as attaining the aforementioned advantages.

The invention has been described with particular reference to a large counter (for example with length measuring, for example, 2,160 mm and with a width measuring, for example, 999.7 mm), in particular with the refrigerated chamber, for ice cream shops, pastry shops and the like.

Those skilled in the art may introduce various modifications and variants, as well as the use of technically equivalent devices or components, and propose simplifications, maintaining the main teaching of the invention i.e. providing an oblique cam associated to the movement of the plate supporting the mobile panel and operatively connected with a horizontal arrangement of the horizontal guide and an arrangement of vertical guides with relative sliding trolleys without departing from the scope of the present invention, as outlined by the claims that follow.

The invention claimed is:

1. A food display counter (10) comprising:

a support framework (12), a vat (14) for containing products to be displayed, said vat delimited by opposite sideboards (18), a front vertical transparent panel (16) for facing a client, a front wall (20) for facing a seller, a bottom (14*a*), and an upper cover formed by i) a transparent fixed longitudinal panel (22) and ii) an adjacent transparent mobile longitudinal panel (24), wherein in a closed position of the mobile longitudinal panel (24), the upper surface of the mobile longitudinal panel (24) is coplanar with the upper surface of the fixed longitudinal panel (22), two lateral devices (27) for controlling opening and closing of the mobile panel (24), support sheets (28) respectively fixed internally to an interior side each of the sideboards (18), each support sheet (28) respectively housing one of the lateral devices (27) and operative transversally with respect to a longitudinal extension of the counter (10), wherein each said two lateral devices (27) comprises an electrical actuator (30) fixed to said support sheet (28), extending along said support sheet (28) and having a slide (44) mobile to and fro and supporting a driving roller (40), the actuator (30) of each lateral device (27) being synchronized electrically with the actuator (3) of the other lateral device (27) to control horizontal positioning of the mobile longitudinal panel (24) during oblique translation of the mobile longitudinal panel (24), a horizontal guide (32) fixed to said support sheet (28) and extending along the support sheet (28) above said electrical actuator (30), at least one trolley (34) associated to and slidable on said horizontal guide (32) and fixed to a slider (36), which has, at a lower part, a seat (38) for housing said driving roller (40) and being longitudinally translatable parallel to said support sheet (28), two vertical guides (46) extending, spaced from each other, on said slider (36) on a side opposite to that a side supporting the at least one trolley (34) slidable on the horizontal guide (32), at least one trolley (48) slidable on each vertical guide (46), associated to the vertical guide (46) and fixed to a support plate (50) facing towards the inner part of the vat (14) and supporting, at an upper part, an end of the mobile panel (24), wherein on a side facing towards said slider (36), the support plate (50) has a pin (56) supporting a bearing (58) adapted to roll on the oblique track (60*a*) of a directional cam (60) fixed to said support sheet (28) and adapted to determine an oblique translation movement of said support plate (50) and of the mobile panel (24) fixed thereto, along an oblique raising and lowering path, from a closing position with translation of the slide (44) of the actuator (30) in a longitudinal direction, or a lowering oblique movement of said support plate (50) and of the associated mobile panel (24) from a raised horizontal opening position in a lowered horizontal, closing position, with translation of said slide (44) of the actuator (30) in the other movement direction, said directional cam (60) being an oblique rectilinear cam.

2. The food display counter according to claim 1, characterised in that the cam (60) has an end with a cradle seat (64) and an opposite end having a stop projection (66) defining the end stop positions of the roller bearing (58).

3. The food display counter according to claim 1, characterised in that on the slider (36) between the two vertical guides (46) there is fixed a support (68*a*) supporting a helical spring (68) operating in expansion and fitted on a stem (70) which is connected through an L-shaped support (72) to the aforementioned support plate (50) and it is guided by a bushing (74).

4. The food display counter according to claim 1, characterised in that each lateral device for controlling the opening and closing (27) has a C-shaped open channel (76), fixed to the sheet (28) beneath the linear guide (32) and provided for housing the supply cables of the associated actuator (30), wherein between said channel (76) and the slider (36) there is provided a shaped support (78) fixed to said slider for anchoring the sheath of said cables.

5. The food display counter according to claim 1, characterised in that the directional cam (60) is supported spaced with respect to said support sheet (28) by interposing spacer elements (62).

6. The food display counter according to claim 1, characterised in that the support sheet (28) with the oblique rectilinear cam (60), the plate-like slider (36) and the support plate (50) are arranged parallel to each other.

7. The food display counter according to claim 2, characterised in that it comprises a cabinet (80) housing a device (81) for weighing the purchased food products and a cash register device (82).

8. The food display counter according to claim 3, characterised in that it comprises a cabinet (80) housing a device (81) for weighing the purchased food products and a cash register device (82).

9. The food display counter according to claim 4, characterised in that it comprises a cabinet (80) housing a device (81) for weighing the purchased food products and a cash register device (82).

10. The food display counter according to claim 5, characterised in that it comprises a cabinet (80) housing a device (81) for weighing the purchased food products and a cash register device (82).

11. The food display counter according to claim 6, characterised in that it comprises a cabinet (80) housing a device (81) for weighing the purchased food products and a cash register device (82).

12. The food display counter according to claim 1, further comprising a compartment housing a refrigeration apparatus located below said vat (14).

13. The food display counter according to claim 1, wherein fixed longitudinal panel (22), the mobile longitudinal panel (24), the front sheet (16) are each made of glass.

14. The food display counter according to claim 13, wherein a volume of the vat for containing the products has a length of about 2.160 m and a width of about 1 m, in which the weight of said mobile longitudinal pane (24) is about 30 kg.

* * * * *